US005662147A

United States Patent [19]

Haiber

[11] Patent Number: 5,662,147

[45] Date of Patent: Sep. 2, 1997

[54] FABRIC PANEL WITH INTER-WOVEN LOOPS

[76] Inventor: Gerd Haiber, Johanniterstr. 10, 72393, Burladingen, Germany

[21] Appl. No.: 541,761

[22] Filed: Oct. 10, 1995

Related U.S. Application Data

[63] Continuation of Ser. No. 73,110, Jun. 7, 1993, abandoned.

[51] Int. Cl.[6] ..... D03D 3/00; A47H 5/032

[52] U.S. Cl. ..... 139/384 R; 160/84.01

[58] Field of Search ..... 139/383 R, 383 B, 139/384 R, 385, 387 R, 387 A, 388, 397, 398, 408, 416; 434/75; D6/575, 578, 580, 581; D8/369, 371, 372; D5/47, 51; 160/84.01, 84.04

[56] References Cited

U.S. PATENT DOCUMENTS

| | | |
|---|---|---|
| 1,039,343 | 9/1912 | White . |
| 2,159,733 | 5/1939 | French . |
| 2,518,301 | 8/1950 | French et al. . |
| 2,888,958 | 6/1959 | Lilley . |
| 3,001,579 | 2/1961 | Van Doren . |
| 3,335,762 | 8/1967 | Noyel . |
| 3,802,609 | 4/1974 | Benedetto . |
| 4,543,145 | 9/1985 | Schnell et al. . |

FOREIGN PATENT DOCUMENTS

| | | |
|---|---|---|
| 3844291 | 7/1990 | Germany . |
| 63-203845 | 8/1988 | Japan . |

*Primary Examiner*—C. D. Crowder
*Assistant Examiner*—Larry D. Worrell, Jr.
*Attorney, Agent, or Firm*—Longacre & White

[57] ABSTRACT

A fabric panel has a large number of parallel rows of loops horizontally in small spacing woven in to it. The loops in the rows are also lined up vertically. By that they form a kind of grid allowing a nearly unlimited choice of stringing options. Changes and adjustments can be done easily without relocating tapes or moving and adding rings. Ring clips to catch two loops in the vertical line for a permanent fold, gathering rings to gather several loops for a packet of folds or, if desired, cord guide rings can be attached to the loops, without diminishing the decorative front side by sewing, tacking or using tapes.

20 Claims, 6 Drawing Sheets

FABRIC PANEL WITH INTER-WOVEN LOOPS

This is a continuation of U.S. patent application Ser. No. 08/073,110 filed on Jun. 07, 1993 now abandoned.

BACKGROUND OF THE INVENTION a) Field of the Invention

The invention relates to a device which serves to gather, or move up and down, decorative textile lengths such as decorative fabrics or curtains. Thus, so-called, "cloud structures" or "M-decorations" can be produced whereby gathering hooks are used in which, according to the decoration, a greater or smaller number of loops are suspended. A lateral formation of packets is also possible by the use of gathering devices described in this invention.

A fabric panel is provided with a large number of parallel rows of loops horizontally woven into the fabric. The loops in the rows are also lined up vertically. With this arrangement, they form a kind of grid allowing a nearly unlimited choice of stringing options. Changes and adjustments can be done easily without relocating tapes or moving and adding rings. Ring clips to catch two loops in the vertical line for a permanent fold, gathering rings to gather several loops for a packet of folds or, if desired, cord guide rings can be attached to the loops, without diminishing the decorative front side by sewing, tacking or using tapes. Shirring the top of the fabric panel allows downward hanging folds between the pull-tapes as in cloud or Austrian shades.

The up and down motion of the decorative length can be effected by means of pulling devices, with in general several pull cords running parallel to the direction of gathering. Such an apparatus is in general termed a "Raffrollo". In the greatest length, the decorative length hangs smoothly. By pulling on the pull cords, more and more cloud structures or folds arise, the higher the curtain is pulled.

b) Description of Related Art

According to the state of the art, the gathering of decorative textile lengths is achieved by the application of tapes on which loops are provided for the attachment of plastic clips, or in which the plastic rings are already made integral, or else have textile loops. These so-called ring tapes are usually sewn on or ironed on in the longitudinal direction at given spacings which define the width of the arc. Occasionally a simple pull tape is also used.

One major category of such gathering devices is heading tapes for drapes and curtains. These heading tapes are manufactured with draw strings as part of the tape in the weaving process. Heading tapes are attached to the top of the flat fabric, which are both in a multiple width of the finished treatment depending on the specific shirring ratio (fullness) of the tape. By tying the draw strings at one end and drawing them at the other end, they form the tape and drapery heading to the finished width in a predetermined, horizontal pattern, which is permanent. It is richer or flatter folds, but based on the shirring ratio (fullness) of the tape.

Heading tapes may also have the technical function to hang a fabric panel (drape/curtain) to the operating system of tracks. For this purpose, a single line of woven (weft and warp) fabric pockets or hook tubes, or a double line for larger hooks are woven into the tape, in a spacing with the tape's predetermined shirring pattern. The hook tubes are strictly a hanging device not a guiding device to form designs. An example of such heading tapes for drapes is described in U.S. Pat. No. 2,518,301 to French et al.

Another category of tapes for window treatments are cord guide tapes to move fabric panels up and down or to gather and move them, as in functional shades or to move them only one time as in stationary shades, valances or similar window treatments. An example of such cord guide tapes is provided by Japanese patent 3,203,845 to Yonezawa.

These cord guide tapes do not have the function of hanging a treatment. Their basic function is to guide independent cords, which are not part of the tape, to move fabric panels. For this purpose, cord guide tapes have evenly spaced loops woven in, or evenly spaced rings attached to them. Depending on the size of the finished treatment, its weight or the pulling pattern desired, at least 2, but mostly several cord guide tapes are sewn vertically to the fabric, parallel to each other, all loops of all tapes lined up horizontally, in order to pull up the fabric panel evenly or exactly to the intended design. The pull-cords themselves are standard products and are available in rolls from appropriate manufacturers. Only as the last step in production, when the treatment is completed, the fabricator ties pull-cords to each pull-tape or sews them into the bottom hem of the treatment in line with the cord guide tape. Then the fabricator threads through the chosen number and sequence of loops or rings (called "stringing") and connect them to the pulling device. Instead of tapes, rings also can be sew on or tacked to the fabric. The same requirement apply, that the rings line up both horizontally and vertically.

In these prior art techniques, the following, among other things, are disadvantageous:

(a) To iron the individual tapes on, the tapes have to be aligned parallel to each other and ironed on. This procedure is timeconsuming and often results in misalignment.

(b) Bad alignment of the tapes relative to each other during ironing on or sewing on leads to an unsightly gathering of the decorative textile length.

(c) Even when the tapes are aligned parallel to each other and finished off aligned at the same edge, the tape is frequently ironed on or sewn on improperly, since the decorative textile length is tensioned differently during the ironed on or sewing on of different tapes. The consequence, among other things, is that the decoration becomes wavy.

(d) The ironed-on tapes become loose at the edges, for example by mechanical stressing due to gathering or to the fold disposition of the decorative length, by the action of UV radiation, etc. The loosening of the tapes takes place at the tape edges and adhesion is effected by the adhesive surface. Defining a coefficient K which denotes a measuring of the loosening of the tapes in dependence on its geometry, there is obtained for a rectangular tape of length '1' and width 'b' with the total length of the tape edges G=2 (1+b), and the surface area of the tape F=(1*b), for the coefficient –K=G/F=2/b+2/l; Formula (1). There exists a great tendency to loosening when K is large. In the use of tapes which have a long length and a small width, it is mainly the small width 'b' which is responsible for a large coefficient K, i.e. a poor adhesion.

(e) The drape of the decorative length is locally different due to the changes between the presence of single and double layers, leading to a disturbance of the harmony of overall impression.

(f) Due to the ironed-on tapes, the rear side of the decorative length is unsightly. This is particularly unattractive when the decorative textile length is to be situated at places where a view of the decorative length from both sides is possible, such as, e.g., room dividers, or for the decorative separation of entrances, passages, etc.

(g) The arrangement of the loops, i.e. the width of the arcs, and hence the gathering of the decorative length, is set once and for all by the ironing or sewing of the tapes onto the decorative length. A change is no longer possible, whether it is by reason of an incorrect imagination of the interior architect, the effect of the gathering, or because of changes of fashion, etc.

(h) The use of tapes indeed enables the customer to freely choose the front side of the decorative length. The advantage of choice of the front side is detracted from, when tapes are used, by the inevitable disadvantage of an unsightly reverse side.

As described in (German Laid-Open Patent) DE 3,844,291-A1, it is likewise conventional to work the loops directly into the decorative length during the production of the decorative length, with loops which follow the pattern of the fabric but do not cover the entire surface of the fabric. Such decorative textile lengths with integrated loops are used for stationary types of curtains known as raschel knit curtains, horizontal weft knit curtains and woven curtains. A few of the above-mentioned disadvantages are indeed eliminated by having the loops integrated into the decorative length; however, the customer is limited to the fabric patterns Of the decorative lengths with integrated loops as predetermined by the producer.

The need therefore exists for a fabric panel having loops integrated into the woven or knitted fabric wherein the loops are aligned in the horizontal and vertical directions to form a grip-like pattern allowing a nearly unlimited choice of stringing options. Moreover, the need exists for a fabric pattern having loops integrated into the fabric during the weaving process wherein the threads forming the loops are surely secured to the fabric by knots a or similar thickenings which lock the threads in place.

SUMMARY OF THE INVENTION

The disadvantages mentioned above in the state of the art are eliminated by means of the present invention.

The fabric panel of this invention has a large number of parallel rows of loops woven into the fabric. The loops in the fabric are preferably aligned in both the horizontal and vertical directions to thereby form a kind of grid allowing a nearly unlimited choice of stringing options. Changes and adjustments can be done easily without relocating tapes or moving and adding rings. Shirring the top of the fabric panel allows downward hanging folds between the pull-tapes as in cloud or Austrian shades.

The fabric panel according to the invention includes a large number of rows of loops of textile threads, which have already been woven into the fabric panel during the weaving process. The loops are an integral part of the fabric and formed in the weaving process by a number of adjacent weft threads intermittently floating across the width of the fabric. The length of the floating sections of the weft threads makes the width of the loops. The sections interwoven with warp threads determine the spacing of the loops. The loops are only on one side of the fabric; the side to which the pull-cords are attached; referred to as the backside. On the other side, the front side, woven warp and weft threads continue under the set of floating weft threads to avoid a hole and also to protect them against any process done to the front of the fabric panel. An individual alignment of the individual tapes is no longer required by the fabric panel according to the invention, since the panel includes a large number of rows of such loops. Because of the rows of loops which are already aligned correctly relative to each other, an unsightly gathering due to bad alignment of the tapes is absent, and the decoration does not become wavy. In that many rows of loops are provided by the invention, and run mutually parallel, the device is wider than the tapes mentioned above. The force on the fabric, which acts transversely of the direction of the rows of loops, is distributed over a wider region due to the greater width of the device, i.e., the surface loading decreases.

It has been shown that it is in general sufficient to form the loops on only one side of the fabric panel.

A high loadability is achieved by the loops that include a plurality of standing threads that lie free on the fabric panel.

The loadability of the device can be still further increased by loops that include at least four (4) standing threads so that a permanent, dimensionally stable decoration is possible even with very heavy decorative lengths, without pulled threads arising, loops tearing, or the like.

The fabric panel may be fixed on a decorative length, such as a decorative drape or curtain, in a simple manner, for example, by means of ironing, adhering, pressing or calendering. With this arrangement, the fabric panel serves as a lining for the decorative length. At the side remote from the loops, an additional fixation of the loops results from the adhesive coating, so that an increase of the loadability of the loops results.

If the direction in which the rows run is defined as the length '1l' of the device and the direction nearly perpendicular to it, in which the rows of loops run nearly parallel to each other, as the width 'b' the device according to the invention, since it has a large number of rows of loops, has in general a larger width than is the case with the tapes used in the prior art. According to Formula (1), the coefficient K which describes loosening is consequently smaller, i.e. a better adhesion of the iron-on coating is achieved by the device according to the invention because of the geometrical situation.

The geometrical construction of the invention has the effect that a better adhesion of the iron-on coating is achieved, i.e., the loosening of the device due to mechanical stresses, or by the action of UV radiation, washing, etc. is reduced by the features according to the invention.

The strength and stability of the device in the region of the loops is also ensured by continuing the textile fibers of the woven or knitted fabric beneath the loop. Thus, the loop is not visible from the side remote from the loops. The woven or knitted fabric situated beneath the loop likewise prevents an incorrect threading of the plastic clip.

A full-surface application of the fabric panel to the decorative length is possible by providing the textile fibers located beneath the loops with an adhesive coating or other adhesive lamination, especially an iron on coating. The adherent surface is nearly identical with the geometric surface, so that nearly the maximum "geometrical adhesion" is obtained. No instabilities appear, which are the preferred loosening places of the adhesion coating, adhesive lining, or iron-on coating.

A fastening of the fabric panel to the decorative textile length may be achieved by sewing the panel to the decorative textile length. This ability to be sewn on is for example important when the decorative length to be provided with the fabric panel is not to be exposed to the required iron-on temperature.

Possible additions to the decorative textile and/or to the panel, which are necessary to make possible a clean sewing and to prevent fraying, are considered by making the planar extents of the fabric panel dimensionally similar to the planar extents of the decorative textile length.

It has been shown that the invention is particularly suitable in practice wherein the fabric panel is a full surface lining for the decorative textile length, has loops integrated into it, and is joined to the decorative textile length over the full surface lining.

The device can be produced in a simple manner and favorably as regards cost, by making the device of woven fabric.

By making the fabric panel of knitted fabric, there are obtained, through the altered structure of the device, another hand and/or another appearance and/or another patterning and/or other or improved textile properties, such as, for example, insulation or UV diffusion.

A reduction of the UV intensity of the radiation passing through the device is achieved by the device according to the invention. A bleaching of the color of the decorative length is likewise reduced by the features according to the invention.

An additional sound insulation and/or heat insulation is achieved according to the present invention.

It is ensured by a color or patterned panel whereby the panel can be adapted to the requirements of the spatial esthetics, for example, to fashion the external appearance of a window, or that of the side of a space divider remote from the decorative length, or to aesthetically match the decorative length.

It is for example possible to attach cord guiding rings for guiding pull cords to the fabric panel, or directly attaching pull cords to the panel, to raise or lower the panel, per se or when it is applied to a decorative textile length, by the use of the loops and of pulling devices, as is for example the case with "cloud-structures" or "Raffrollos".

It is ensured by attaching gathering devices such as plastic clips, marker hooks, fold retainers, and gathering hooks to the loops that the device can be gathered, or laid in folds, in order to produce decorative structures such as, for example, cloud structures.

A preferred embodiment of the invention in its application results from employing a fabric panel that is part of a window curtain or a "Raffrollo".

By providing substantially more loops across the width or the height of the fabric panel or lining than is required for arranging the decorative textile lengths in clouds patterns or Raffrollos, the decorator can optionally create nearly any esthetic structure; thus the width of the clouds or folds can be locally different, for example increasing symmetrically towards the middle, or the density of the cloud curves or folds can fluctuate periodically. A change of the cloud height or fold height, and also of their distance apart, is likewise possible. The height of the clouds or folds can increase from above to below, or vice versa; successive clouds and/or folds can be produces with larger and smaller heights, etc. Due to the large number of loops, unconventional configurations are possible with respect to the width and/or height. Even "chaotic" configurations can be moved up and down without problems. It is very easily possible, by means of the device according to the invention, to alter or completely newly reconfigure the height and width, by altering the arrangement of the gathering devices.

When the fabric panel or lining is for the most part of a plain weave type, the device is particularly suitable in practice.

It is possible, by means of the features of the invention, for the suspension to take place on the device itself. This is of advantage when, for example, the decorative length is not available in the required length measurement, so that, for example when a blind covers the suspension, the full length of the decorative length can be optionally made use of, without losses of the material occurring due to the suspension.

It is possible by arranging silicone paper between individual layers of the fabric to store the fabric correctly as regards the materials. The silicone paper arranged between the individual layers of the device, a sticking together of the device is prevented, even at high temperatures. Moreover, the device is protected against dirt, dust, moisture, sunlight, etc.

It is ensured by ironing the fabric panel to the decorative textile length in coincident registration that the fabric panel can be ironed onto the decorative textile length fold-free and with the additional fixation of the loops by the iron-on coating.

Gathering only in a desired partial region, for example only in the lower region, or only on one side, can be achieved by only partially covering the decorative textile lengths with the fabric panel.

A fixation of the loops in the fabric, so that no pulled threads are formed on insertion of plastic clips, marker hooks, fold retainers or gathering hooks, is achieved by thickened portions or knots that fix or lock the standing threads in the fabric panel relative to the non-raised threads.

BRIEF DESCRIPTION OF THE DRAWINGS

The invention will now be described with reference to a preferred embodiment. In the drawings.

DETAILED DESCRIPTION OF THE PREFERRED EMBODIMENTS

Figure 1:
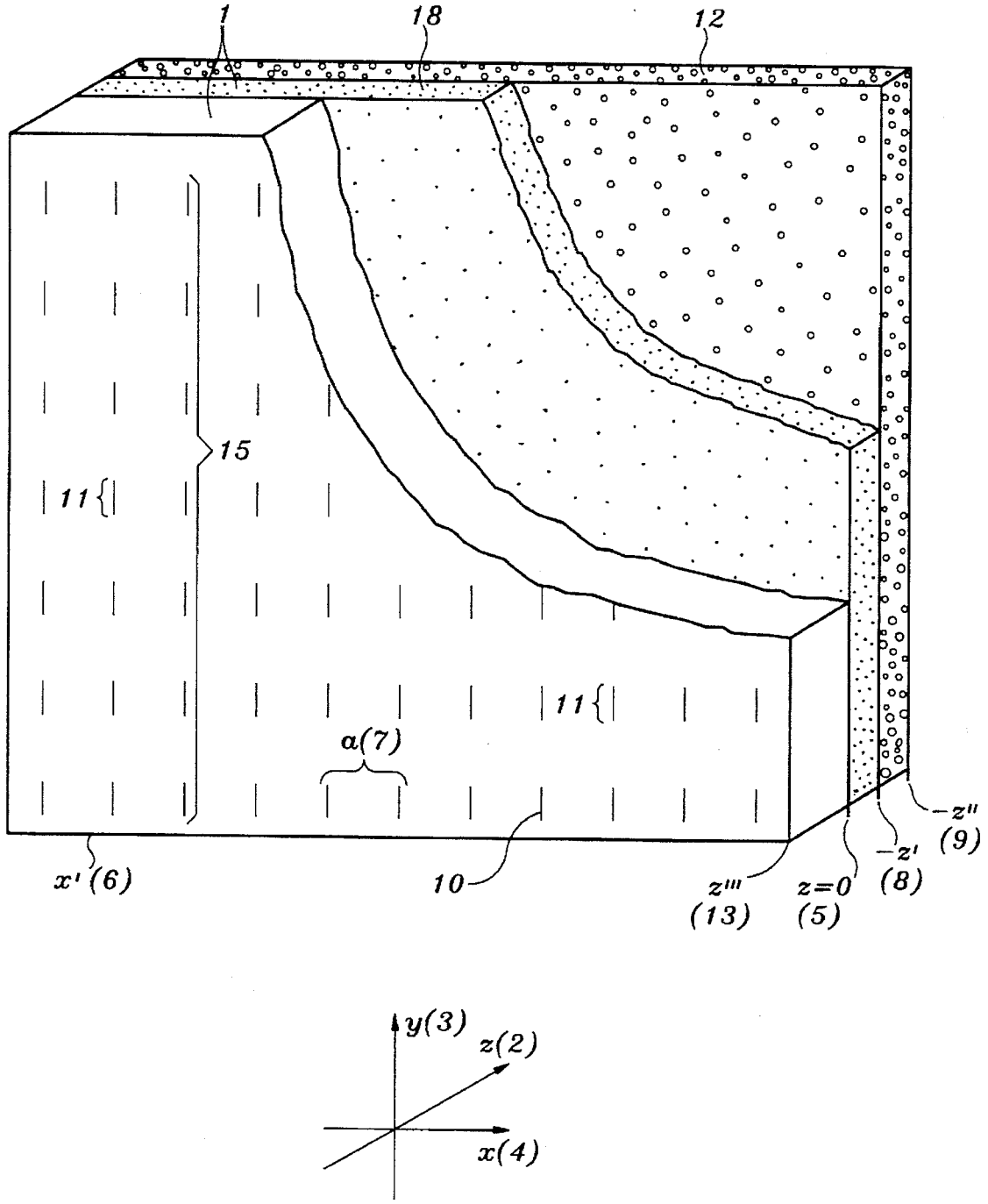
FIG. 1 shows a broken away, three-dimensional schematic view of a preferred embodiment of the invention, which is ironed onto a decorative textile length.

FIG. 1 shows a preferred embodiment of a fabric panel 1, which is woven, in a broken-away, three-dimensional schematic representation. This woven fabric panel 1 may be ironed onto a decorative textile length 12. The z-direction or depth 2 is shown enlarged in comparison with the x-direction or width 4 and the y-direction or height 3. The loops 10 are an integral part of the fabric and formed in the weaving process by a number of adjacent weft threads intermittently floating across the width of the fabric as will be described in more detail below with reference to FIG. 2–5. The length of the floating sections of the weft threads makes the width of the loops. The sections interwoven with warp threads determine the spacing of the loops. Loops 10 are integrated into this fabric panel, and are located on only one side of the device, which is termed the "front side" below. The loops 10 are arranged in rows 15, which run nearly at right angles to the gathering direction, which is the same as the x-direction 4. A row of loops has nearly the same x-coordinate x' 6. The individual rows 15 of loops are arranged nearly parallel to each other at a spacing 'a' 7. From the location of a given loop, a loop of the adjacent row of nearly equal height is reached in the gathering direction. 0n the "reverse" face of the device, remote from the loops, the fabric panel is preferably provided over the full surface with an iron-on coating 18. The iron-on coating extends over the whole x-y surface spanned by the fabric panel 1 and reaches in the z-direction from 5 (z=0) to 8 (z=z'). The decorative textile length 12, onto which the fabric panel 1 is ironed, is adjoined over its whole surface and reaches in the z-direction 2 from 8 (z=–z') to 9 (z=–z").

The rows 15 of loops 10 of the device can run at an optional angle to the vertical direction of a suspended textile length. It is preferred that the rows 15 run perpendicularly or parallel to this vertical direction of the suspended textile length, and it is particularly preferred that they run parallel to it.

Figure 2:
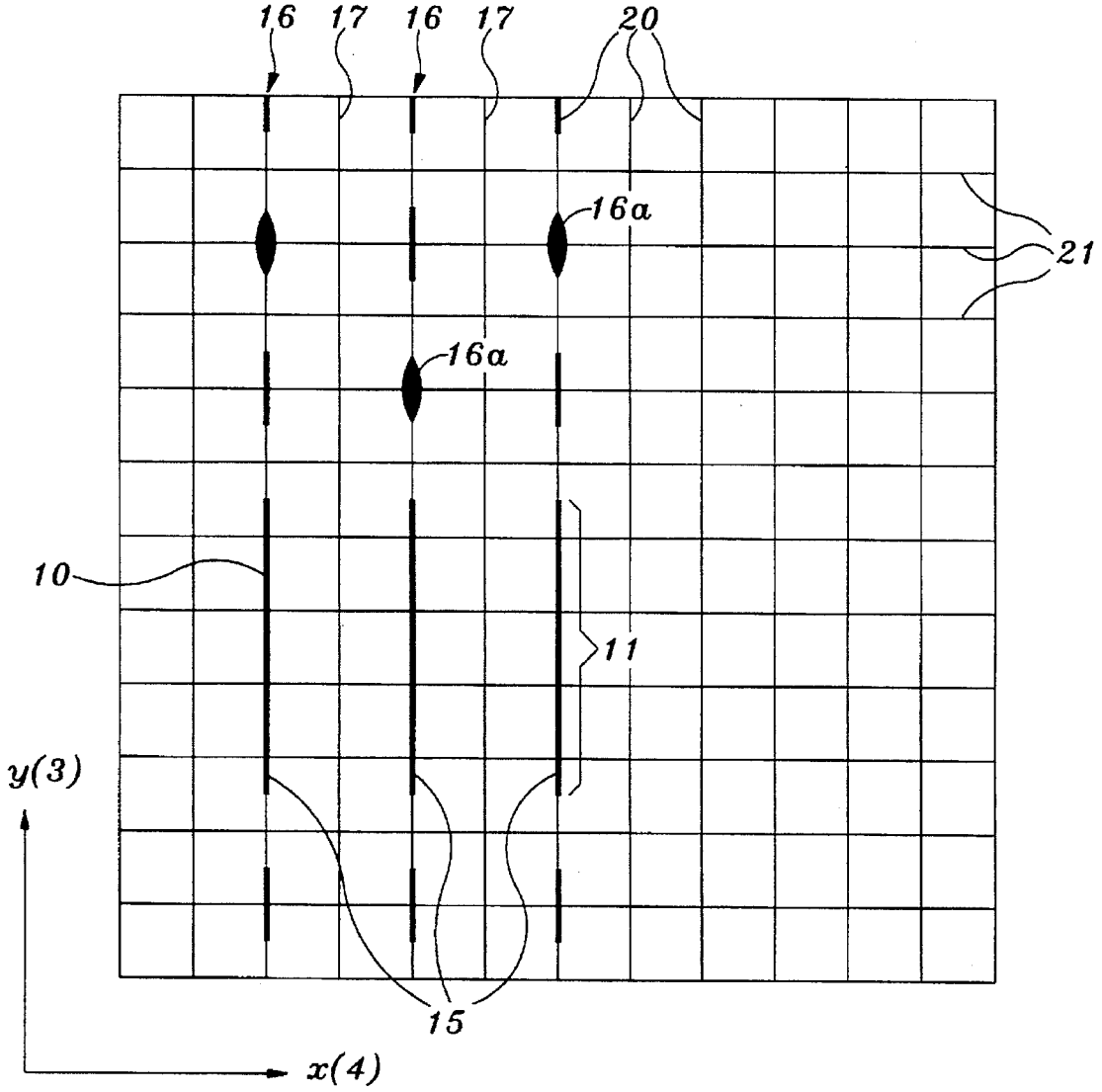
FIG. 2 shows an enlarged top view representation of the surface which is spanned by the xy-plane in FIG. 1 at the location z=z'" ("front side").

FIG. 2 shows an enlarged top view of the preferred embodiment from FIG. 1, where the cut-out area shown represents the region of a loop in the surface characterized by 13 (z=z'") and arbitrary x, values. Numerous threads running vertically 20 and horizontally 21 can be recognized. The loops are so-called "floats" or "standing threads", by which there are understood, in weaving technology, threads in woven and knitted fabrics which are repeatedly not bound in and therefore lie free on the fabric. The so-called "standing threads", which could perhaps be a more precise expression for the loops 10, are clearly shown in perspective view of FIGS. 3, 4 and 5. The floats or standing threads are preferably anchored in the fabric panel 1 to prevent pulled threads and for stabilization. According to the preferred embodiment shown in FIGS. 2 and 5, the float threads 16 can for example be provided with nubs, flecks, slubs, knot, or other thickenings 16*a*, which serve to fix or lock the loop in the fabric, having the result that no pulled threads arise. In other words, the knot-like thickening 16*a* prevents the thread(s) 16 from being pulled relative to the non-raised threads 17, 21 when tension is applied to these float threads 16 when the textile is suspended during use.

The float threads 16 are represented such that only the portion of the float thread visible on the front side, and the loop(s) itself, are visible. The float threads can either be warp threads or weft threads; although they are preferably weft threads. It is preferred that each loop 10 consists of several float threads bunched together, and a grouping of at least 4 float threads is particularly preferred. One or more intermediate threads 17 run between two float threads 16. This forms a fabric with the transverse threads 21, running in the x-direction, in the region beneath the loop 10, so that rearward there is no hole at the place of the loop.

Figure 5:
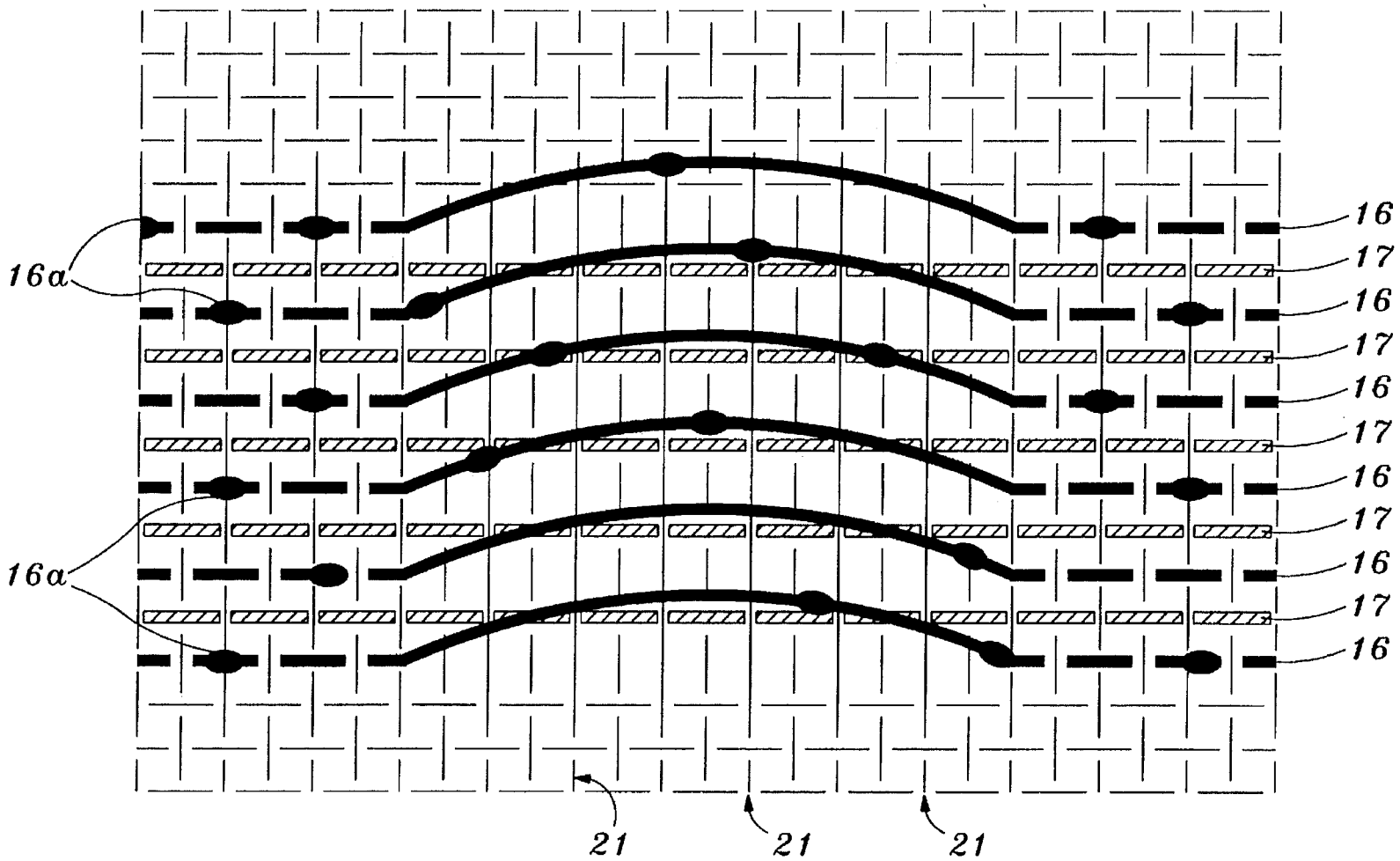
FIG. 5 shows a further enlarged view of the threads of the fabric panel of FIGS. 1, 3 and 4.

This arrangement is clearly shown in perspective view in FIG. 5, where float threads 16, and preferably a grouping of at least 4 float threads 16, are raised above the transverse threads 21 to form the loop 10.

Figure 3:
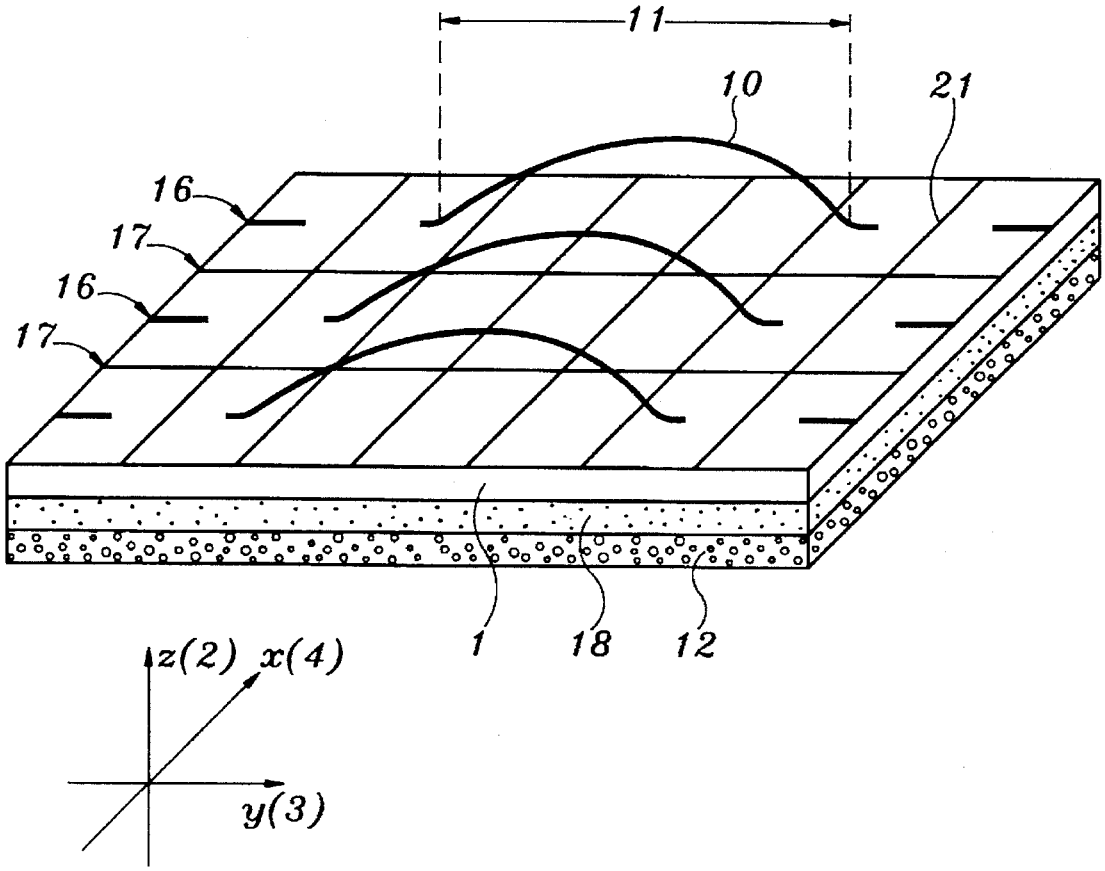
FIG. 3 shows a view, obliquely from the side, of FIG. 1.

An enlarged side view of the fabric panel 1, which is coated with an iron-on coating 18, is shown in FIG. 3, in which the fabric lying approximately beneath the loop 10 is visible, and is formed by the intermediate threads 17 running between the float threads 16 and the transverse threads 21 running in the x-direction 4.

Figure 4:
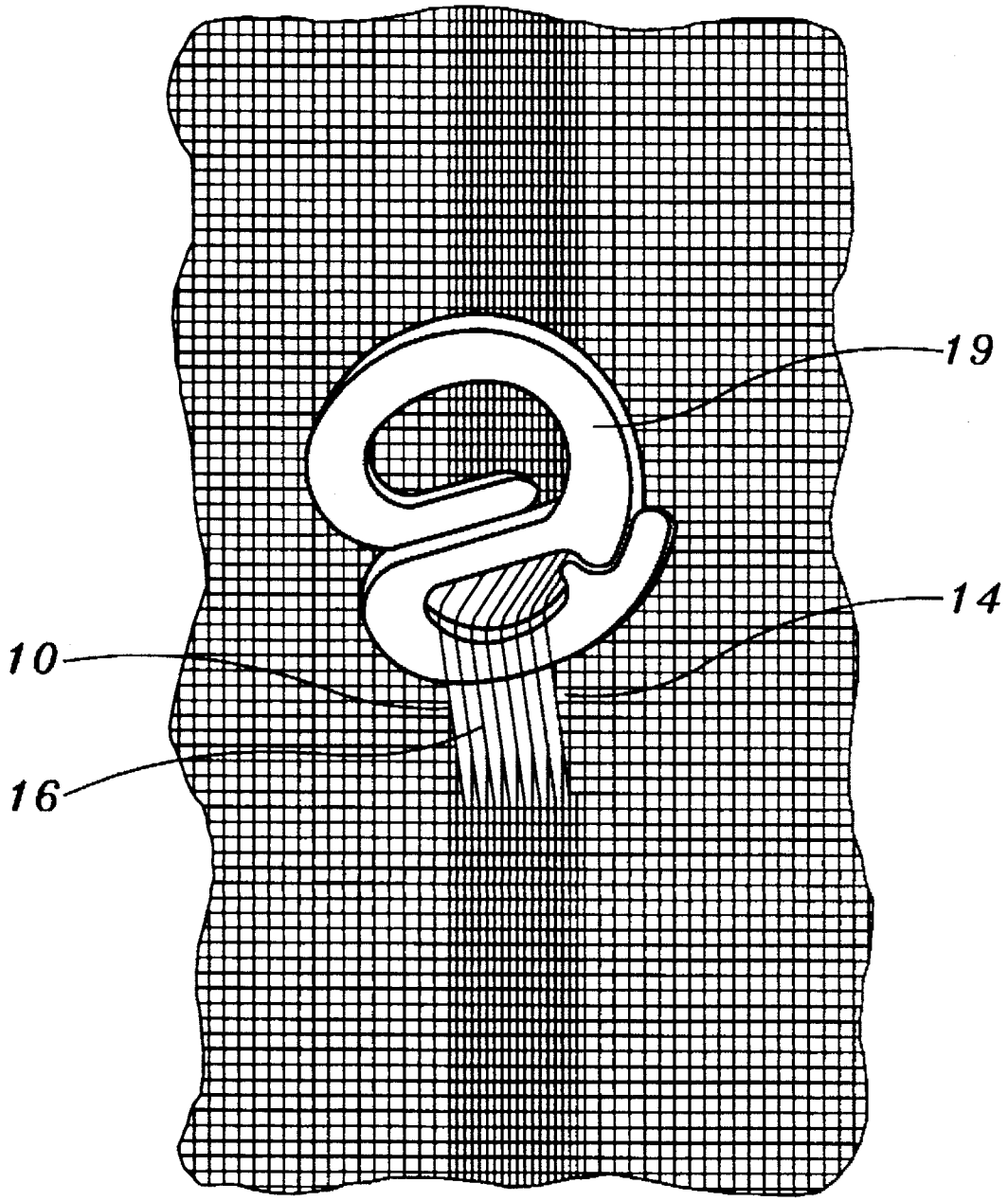
FIG. 4 shows a naturalistic 200% enlarged illustration of a preferred embodiment.

In the 200% enlarged naturalistic illustration in FIG. 4, a loop 10 consisting of 8 float threads 16 is shown. By way of example, a gathering hook 19 may be inserted in the loop 10 to thereby provide an attachment means for direct attachment of pull cords, and beneath the loop a portion of the fabric 14 lying thereunder is visible.

Figure 6:
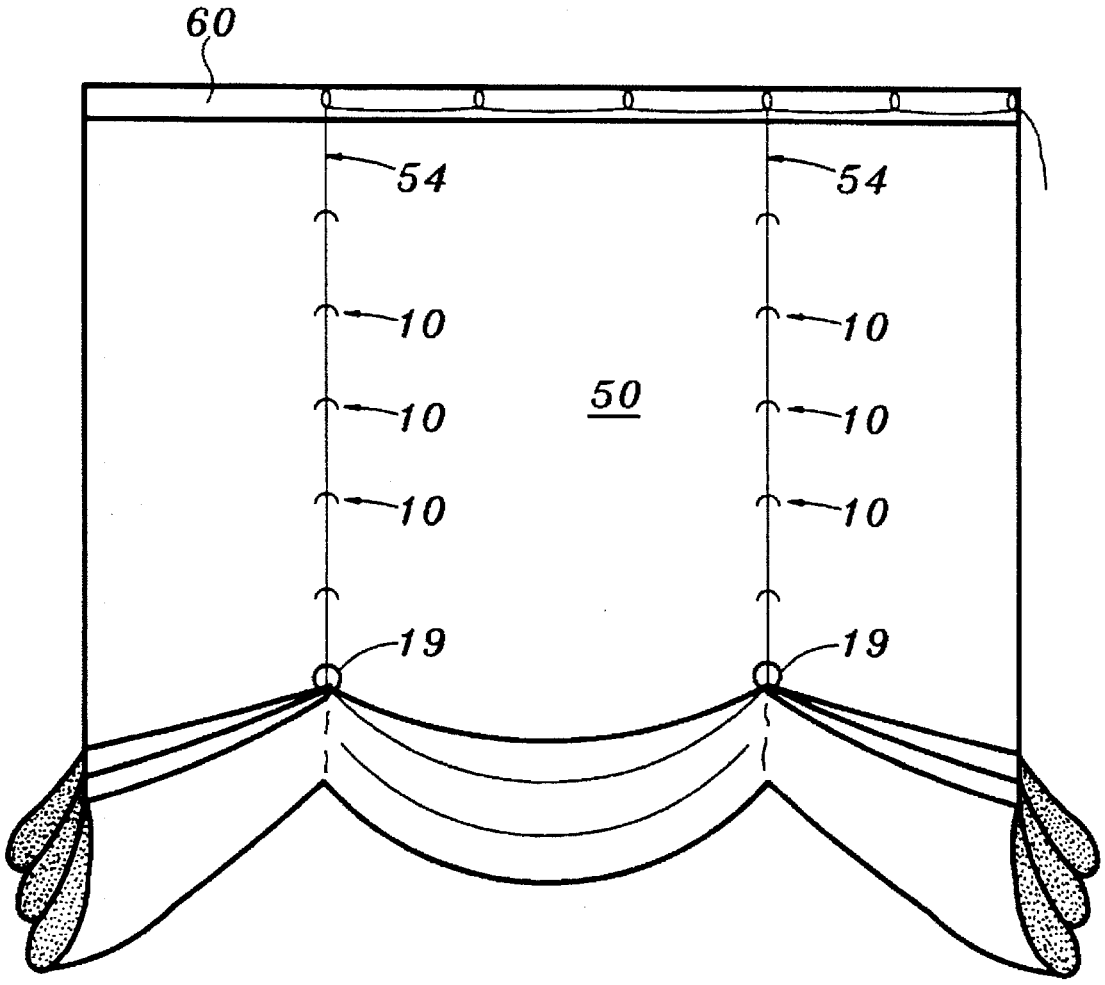
FIG. 6 shows by way of a example a textile having a suspension means supporting the textile with a gathering ring employed with the loops of the present invention to gather up or draw up the textile to achieve a cloud-shaped fabric.

FIG. 6 shows by way of a example a textile having a suspension means 60 supporting the textile 50 with gathering rings 19 being employed with the loops 10 of the present invention to gather up or draw up the textile 50 by the pull cords 54 to achieve a cloud-shaped fabric.

While the foregoing invention has been shown and described with reference to the several preferred embodiments, it will be understood by those having skill in the art that various changes in form and detail may be made without departing from the spirit and scope of the invention.

I claim:

1. A fabric panel for use as a window decoration, said fabric panel defining a first side and a second side opposite to said first side and formed by a plurality of warp threads running in a first direction and a plurality of weft threads running in a second direction transverse to said first direction; said panel comprising:

a plurality of loops projecting from said first side, said plurality of loops being formed in the weaving process by a raised portion of a number of float threads intermittently projecting from said first side, each said floats threads having a predetermined diameter, a width of each of said loops being defined by a length of said raised portion of said number of float threads projecting from said first side, wherein said float threads forming said plurality of loops are formed prior to the weaving process with a plurality of discrete thickened portions disposed along an axial length of said float threads, said thickened portions having an enlarged diameter with respect to said first diameter for locking said float threads relative to adjacent warp and weft threads.

2. The fabric panel according to claim 1, wherein said float threads are aligned with said weft threads.

3. The fabric panel according to claim 1, wherein said plurality of loops are aligned in both said first and said second directions to thereby form a grid-like pattern of loops.

4. The fabric panel according to claim 3, wherein said plurality of loop are disposed across substantially all of said first side in both said first and second directions.

5. The fabric panel according to claim 1, wherein at least one intermediate thread is located between adjacent float threads, said intermediate thread extending parallel to said float threads.

6. The fabric panel according to claim 1, wherein a plurality of transverse threads extend in a direction transverse to said float threads in a region beneath each raised portion in order that no hole is present in said fabric at a location of each of said plurality of loops.

7. A window decoration comprising a decorative fabric and a fabric lining, said decorative fabric being defined by a first side and a second side opposite to said first side, said fabric lining overlying said first side, and being formed by a plurality of warp threads running in a first direction and a plurality of weft threads running in a second direction transverse to said first direction; and, a plurality of loops projecting from an exposed side of said fabric lining opposite to said decorative fabric, said plurality of loops being formed during a weaving process of said fabric lining by a raised portion of a number of float threads intermittently projecting from said first side, a width of each of said loops being defined by a length of said raised portion of said number of float threads projecting from said first side, wherein said fabric lining is affixed to said decorative fabric, and wherein said fabric lining is integral formed during said weaving process to include at least two columns of said loops, at least two rows of said loops disposed transverse to said columns, and a plurality of intermediate planar portions void of said loops interposed between said columns and rows.

8. The window decoration according to claim 7, wherein said fabric lining is affixed to said decorative fabric by a laminated coating of adhesive material located between said fabric lining and said first side of said decorative fabric.

9. The window decoration according to claim 7, wherein said fabric lining covers substantially the entire surface defined by said first side.

10. The window decoration according to claim 7, wherein said float threads forming said plurality of loops are formed with knot means for locking said float threads relative to said warp and weft threads.

11. The window decoration according to claim 7, wherein said plurality of loops are aligned in both said first and said second directions.

12. The window decoration according to claim 11, wherein said plurality of loops are disposed across substantially all of said first side in both said first and second directions.

13. The window decoration according to claim 7, wherein at least one intermediate thread is located between adjacent float threads, said intermediate thread extending parallel to said float threads.

14. The window decoration according to claim 7, wherein a plurality of transverse threads extend in a direction transverse to said float thread in a region beneath each raised portion in order that no hole is present in said fabric at a location of said raised portion.

15. The window decoration according to claim 7, further comprising cord guiding means attached to said loops for guiding pull cords affixed to said lining.

16. The window decoration according to claim 7, wherein said lining is woven.

17. The window decoration according to claim 7, wherein said lining is knitted.

18. The window decoration according to claim 7, wherein said fabric lining is affixed to said decorative fabric by a stitching.

19. A fabric panel for use as a window decoration, said fabric panel defining a first side and a second side opposite to said first side and formed by a plurality of warp threads running in a first direction and a plurality of weft threads running in a second direction transverse to said first direction; said panel comprising:

a plurality of loops projecting from said first side, said plurality of loops being formed in a weaving process by a raised portion of a number of float threads intermittently projecting from said first side, a width of each of said loops being defined by a length of said raised portion of said number of float threads projecting from said first side, wherein said fabric panel is integral formed during said weaving process to include at least two columns of said loops, at least two rows of said loops disposed transverse to said columns, and a plurality of intermediate planar portions void of said loops interposed between said columns and rows.

20. A window decoration comprising a decorative fabric and a fabric lining, said decorative fabric defining a first side and a second side opposite to said first side, said first and second sides defining peripheral edges of said decorative fabric, said fabric lining overlying said first side and substantially extending to each of said peripheral edges, and being formed by a plurality of warp threads running in a first direction and a plurality of weft threads running in a second direction transverse to said first direction; and, a plurality of loops projecting from an exposed side of said fabric lining opposite to said decorative fabric, said plurality of loops being formed during a weaving process of said fabric lining by a raised portion of a number of float threads intermittently projecting from said first side, a width of said loop being defined by a length of said raised portion of said number of float threads projecting from said first side, wherein said fabric lining is affixed to said decorative fabric.

* * * * *